US006288685B1

(12) United States Patent
Thomas

(10) Patent No.: US 6,288,685 B1
(45) Date of Patent: Sep. 11, 2001

(54) SERRATED SLOT ANTENNA

(75) Inventor: David L. Thomas, San Jose, CA (US)

(73) Assignee: Schlumberger Resource Management Services, Inc., Norcross, GA (US)

( * ) Notice: Subject to any disclaimer, the term of this patent is extended or adjusted under 35 U.S.C. 154(b) by 0 days.

(21) Appl. No.: 09/150,495

(22) Filed: Sep. 9, 1998

(51) Int. Cl.[7] ..... H01Q 13/12
(52) U.S. Cl. ..... 343/769; 343/897
(58) Field of Search ..... 343/769, 770, 343/771, 786, 897, 898, 899; 29/600; H01Q 13/12

(56) References Cited

U.S. PATENT DOCUMENTS

| | | | | |
|---|---|---|---|---|
| 2,501,430 | | 3/1950 | Alford | 343/767 |
| 2,508,084 | * | 5/1950 | Alford | 343/769 |
| 2,611,865 | | 9/1952 | Alford | 343/767 |
| 2,611,866 | * | 9/1952 | Alford | 343/769 |
| 4,819,003 | * | 4/1989 | Goto et al. | 343/771 |
| 5,298,894 | | 3/1994 | Cerny et al. | 340/870.02 |
| 5,621,419 | | 4/1997 | Meek et al. | 343/770 |
| 5,917,454 | * | 6/1999 | Hill et al. | 343/770 |

FOREIGN PATENT DOCUMENTS 2 291 272 1/1996 (GB) .

* cited by examiner

*Primary Examiner*—Michael C. Wimer
(74) *Attorney, Agent, or Firm*—Fish & Richardson P.C.

(57) ABSTRACT

A serrated slot antenna includes two annular conductors separated by a slot having a serrated edge. A shorting post connects the annular conductors to each other at some point along the slot. The slot antenna can be made, e.g., by affixing conductive tape to a flexible substrate, photoetching a pattern in the copper-clad surface of a flexible substrate, or machining material from a conductive tubing.

20 Claims, 5 Drawing Sheets

SERRATED SLOT ANTENNA

CROSS REFERENCE TO RELATED APPLICATIONS

This application is related to copending U.S. application Ser. No. 08/929,161, which is incorporated by reference.

BACKGROUND

The invention relates to a slot antenna.

Wireless radio systems are used in remote metering (e.g., utility metering) applications in which electronic components must be placed in spaces not originally designed for such components. In water metering applications, for example, a transceiver and an antenna typically must fit within a small underground housing originally intended only for a mechanical water meter. In such an application, antenna performance is impeded because the antenna must transmit through the walls and lid of the underground housing and through the ground itself.

SUMMARY

In one aspect, the invention features an annular serrated slot antenna having two annular conductive elements separated by a slot having a serrated edge. A third conductive element, e.g., a shorting post, connects the annular conductive elements together at some point along the slot.

In some embodiments, the annular antenna may be formed on a flexible substrate, and the conductive elements may be formed from conductive tape affixed to the flexible substrate. The serrations may be evenly spaced, and each may have a width that is equal to the spacing between the serrations.

In another aspect, the invention features a serrated slot antenna that is not annular. The antenna includes two generally parallel conductive elements separated by a slot having a serrated edge. A third conductive element connects the conductive members together at some point along the slot.

In other aspects, the invention relates to making a slot antenna. For example, an annular slot antenna may be formed by joining two ends of a generally straight slot antenna to form an annular slot structure. Alternatively, a slot antenna may be made by positioning two annular or straight conductive elements to form a slot between them and connecting a third conductive element to each of the annular conductive elements to form at least one end of the slot. The antenna also may be made by forming a slot pattern on the conductive surface of a flexible substrate. Two ends of the flexible substrate may be joined to form an annular slot antenna. An annular slot antenna also may be formed by removing material from a conductive tubing to form two conductive rings connected by a shorting element at some point along a perimeter of the tubing. Serrations may be formed along an edge of the slot in any of these antennas to create a serrated slot antenna.

Each embodiment of the invention may provide any one or more of several advantages. For example, the antenna may be made small enough to fit entirely or partially within a pre-drilled hole formed in a standard underground housing lid. The antenna also may be housed within a protective structure that passes through such a pre-drilled hole and that positions the antenna above the ground.

Vertical polarization of an antenna may be achieved with a very small vertical dimension (e.g., 0.5" or less). A simple slot structure may be used to create an antenna having an omnidirectional radiation pattern. The conductors used to form the slot structure may have different heights (an "offset slot" structure), which allows, among other things, more clearance between the radiating slot and an underground housing lid. Furthermore, the antenna may be fed at a position offset from the center of the slot, which provides a simple way to match the input impedance of the antenna with the characteristic impedance of the conductor feeding the antenna.

The antenna may include a dielectric other than air to reduce the wavelength of a transmitted or received signal in the antenna, which in turn allows, among other things, reduction of the slot length and thus reduction of the antenna's overall dimensions. Furthermore, an antenna with a serrated slot operates at a lower resonant frequency than an otherwise identical antenna and therefore reduces or eliminates the need for a dielectric to reduce the antenna's resonant frequency.

The antenna may be fabricated easily and inexpensively from, e.g., a conventional straight slot antenna or from conductive wires, strips, or tape. Other embodiments and advantages of the invention will become apparent from the following description and from the claims.

DETAILED DESCRIPTION

Figure 1:
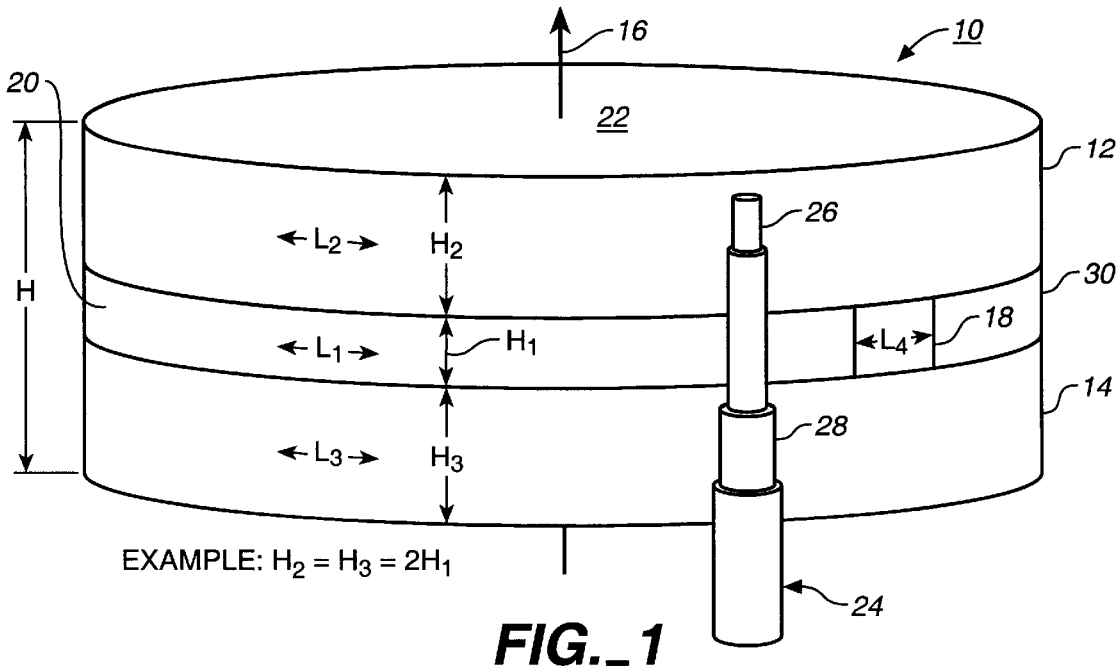
FIG. 1 is perspective view of a vertically-polarized, omnidirectional antenna.

Referring to FIG. 1, a vertically-polarized, omnidirectional slot antenna 10 consists of two annular (or ring-shaped) conductors 12, 14 centered along a common longitudinal axis 16 and joined by a conductive shorting post 18. The annular conductors are separated by a slot 20, the circumferential dimension $L_1$ ("length") of which equals the length $L_2$, $L_3$ (circumference) of each annular conductor 12, 14 less the length $L_4$ of the conductive shorting post 18. The vertical dimension $H_1$ ("height") of the slot 20 defines the distance separating the annular conductors 12, 14. The annular conductors 12, 14 and the conductive shorting post 18 may consist of virtually any conductive material, but highly conductive metals, such as copper, silver, or aluminum, are especially suited for use in the antenna 10. The annular conductors 12, 14 may be conductive strips with height dimensions $H_2$, $H_3$, as shown in FIG. 1, but other structures, such as conductive wires, also may be used.

The antenna is driven by signals from a bipolar signal feed element 24, such as a coaxial cable or a balanced two-wire line, the conductors 26, 28 of which each connect to one of the annular conductors 12, 14. Because the conductors 26, 28 of the signal feed element 24 connect across the slot 20, the annular conductors 12, 14 are driven at opposite polarities, creating a vertically-polarized electric field. Unlike a standard center-fed slot antenna (i.e., an antenna fed at a position equidistant from the slot's ends), antenna 10 may be fed at any point along the length $L_1$ of the slot 20 (i.e., the signal feed element 24 may be connected at any point along the periphery of the annular conductors). Typically, the position of the signal feed element 24 is selected so that the input impedance of the antenna 10, as seen by the signal feed element 24, matches the characteristic impedance of the feed element 24. The antenna's input impedance is approximately zero if the feed element 24 is connected at the shorting post 18 and increases as the feed position moves away from the shorting post 18 toward the center of the slot 20. When a typical fifty ohm coaxial cable is used as the feed element 24, the feed position is selected to yield an input impedance of 50+j0 ohms. In practice, the appropriate feed position for a particular antenna may be determined by measuring continuously the antenna's input impedance as the position of the feed element 24 is varied.

The annular conductors 12, 14 typically wrap around a cylindrically-shaped dielectric insulator 22. In general, any dielectric material may be used, including inexpensive materials such as Styrofoam®, Teflon®, or plastics having relatively low dielectric losses. In some applications, air may serve as the dielectric, eliminating the need for the insulator 22, in which case a non-conductive support member could be positioned opposite the shorting post 18 to support the annular conductors 12, 14.

The diameter of the dielectric insulator 22, and therefore the lengths of the annular conductors 12, 14 and the slot 20, are determined by several factors, including the frequency at which the antenna 10 is to operate and the dielectric constant (K) of the insulator 22. In general, the length $L_1$ of the slot 20 should be less than but approximately equal to ½-wavelength in the dielectric at the desired frequency of operation, which allows the antenna 10 to operate with no phase reversals in the RF currents created in the antenna 10. The exact length of the slot 20 is determined by adjusting its length until the antenna is near resonance at the desired operating frequency. Since the wavelength of a transmitted or received signal in the antenna 10 is inversely proportional to the square-root of the effective dielectric constant of the insulator 22 and surrounding air, the diameter of the insulator 22 declines as the dielectric constant of the material increases.

The height H of the antenna is limited only by the spacial constraints of the application in which it is to be used and by the minimum heights of the annular conductors 12, 14 and the slot 20 required for proper operation. The antenna 10 therefore is vertically-polarized with a very small minimum vertical dimension, and because the antenna 10 is annular and has no phase reversals in the RF currents, its radiation pattern is omnidirectional (i.e., the antenna radiates a full 360° around the longitudinal axis 16).

The annular conductors 12, 14 and the shorting post 18 may be fastened to the dielectric insulator 22 in many ways. For example, the annular conductors 12, 14 and the shorting post 18 may consist of a conductive strip with an adhesive backing (e.g., copper tape) that adheres to the dielectric insulator 22. A conductive material, such as a metallic wire or solder connection, may be used to bridge any gaps that may exist between the shorting post 18 and either of the annular conductors 12, 14. Alternatively, the annular conductors 12, 14 and the shorting post 18 may be set into grooves formed in the outer surface 30 of the dielectric insulator 22.

Figure 2:
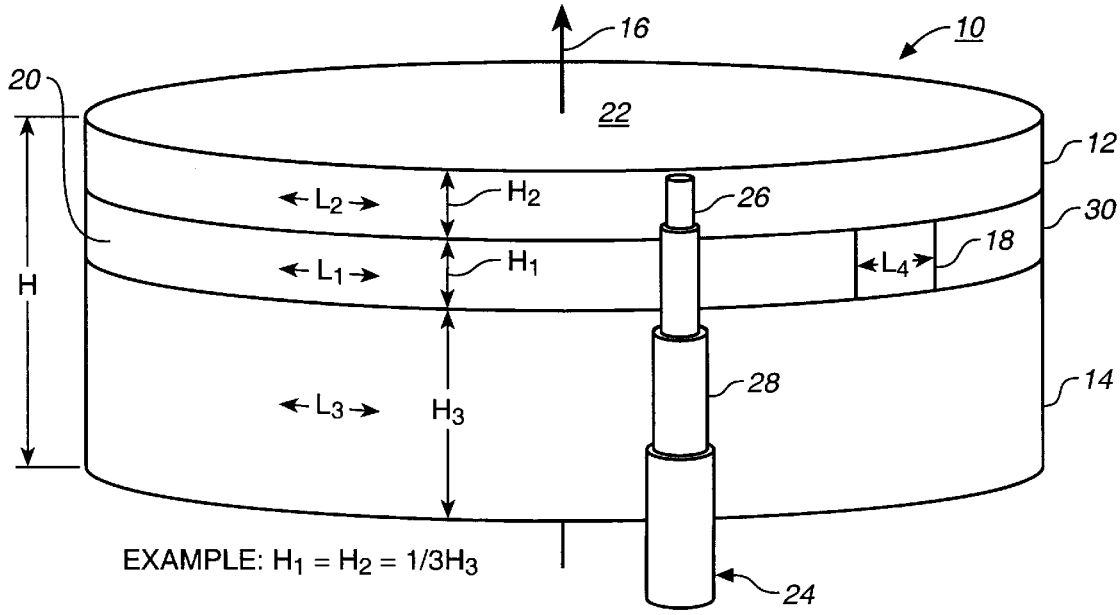
FIG. 2 is a perspective view of an alternative configuration of a vertically-polarized, omnidirectional antenna.

In FIG. 1, the annular conductors 12, 14 are of approximately equal height and have height dimensions $H_2$ and $H_3$ that are approximately twice as large as the height dimension $H_1$ of the slot 20. This configuration produces a radiation pattern that travels in a direction generally perpendicular to the longitudinal axis 16 of the antenna and that is centered at the middle of the antenna's overall height dimension H. Referring also to FIG. 2, the height dimension $H_3$ of the lower conductor 14 may be greater than that of ($H_2$) of the upper conductor 12. This places the slot 20 nearer the top of the antenna 10, which in turn causes the antenna 10 to radiate energy at points higher than those emitting energy in the configuration of FIG. 1. The configuration of FIG. 2 is useful, e.g., when the antenna 10 is to operate close to the ground, such as in the underground metering application described below.

Figure 3:
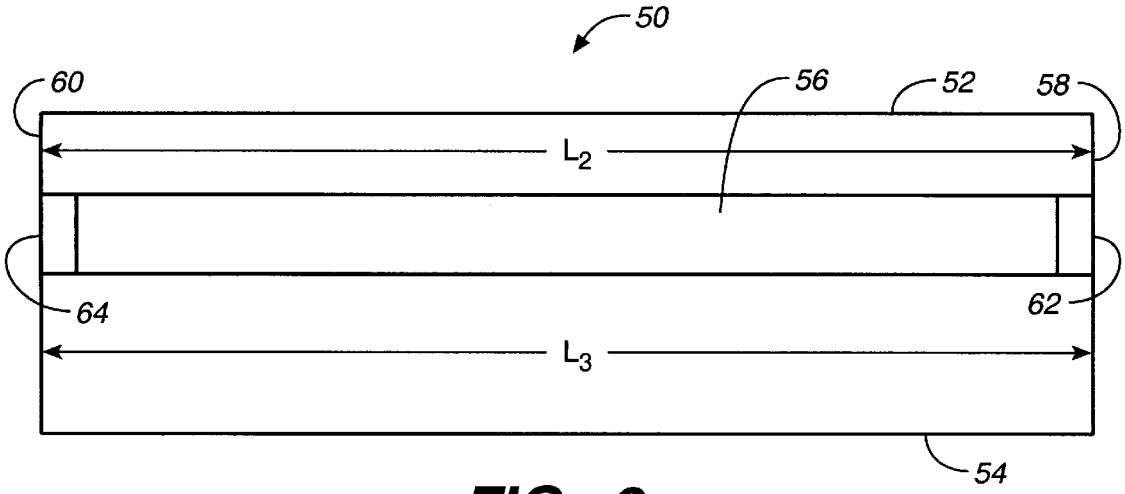
FIG. 3 is a view of a straight slot antenna that may be used to form a vertically-polarized, omnidirectional antenna.

Referring to FIG. 3, an annular slot antenna may be formed from a straight slot antenna 50 having two conductors 52, 54 of similar lengths $L_2$, $L_3$. The conductors are separated by a slot 56 and connected at their ends 58, 60 by shorting posts 62, 64. An annular slot antenna is formed by bending the straight slot antenna 50 until its ends 58, 60 meet and then securing (e.g., soldering) the ends 58, 60 together. When the ends 58, 60 are connected, the shorting posts 62, 64 join to form a single shorting post like that shown in FIG. 1 and FIG. 2. The straight slot antenna 50 may or may not be wrapped around a dielectric insulator.

Figure 4B:
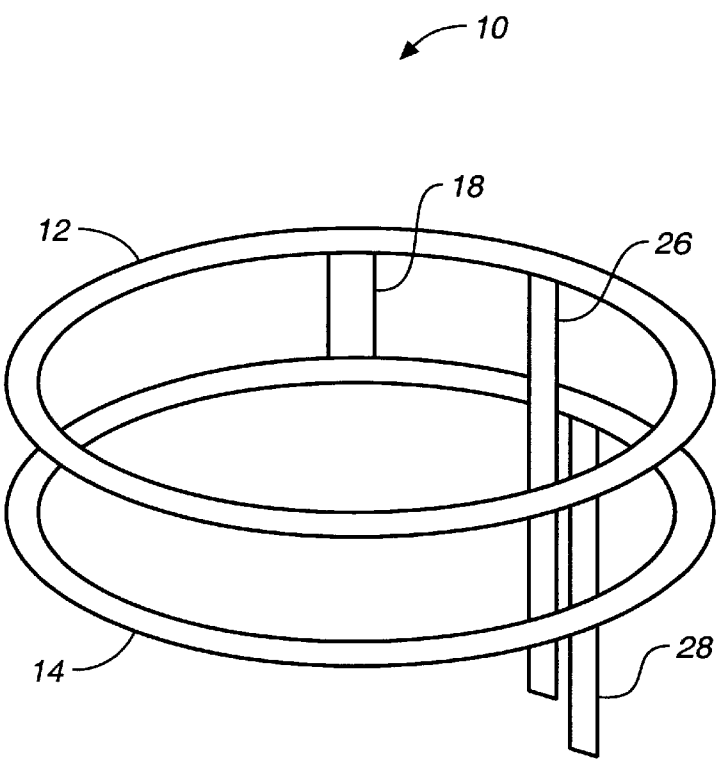
FIGS. 4A and 4B are views of a die-cut stamp that may be used to form a vertically-polarized, omnidirectional antenna.
Figure 4A:
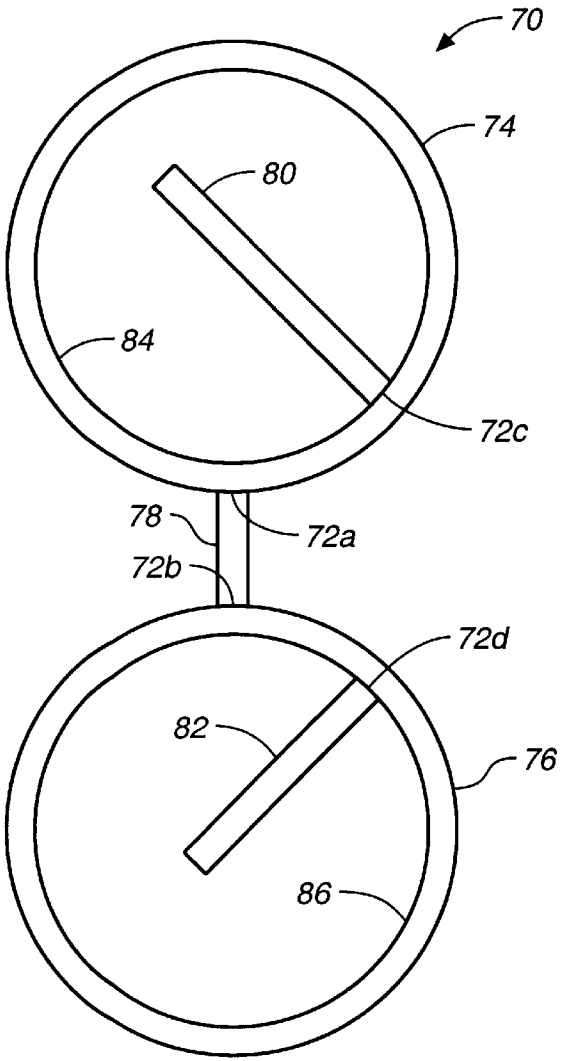

Referring to FIGS. 4A and 4B, the antenna also may be formed from a die-cut stamp 70 created from a conductive (e.g., aluminum) sheet. The stamp 70 includes two annular sections 74, 76 connected together by a conductive post 78. The annular sections 74, 76 intersect the post 78 at two "bend points" 72*a*, 72*b*, respectively. Two conductive stems 80, 82 extend from the inner surfaces 84, 86 of the annular sections, intersecting the annular sections at two additional "bend points" 72*c*, 72*d*, respectively. The die-cut stamp 70 is inexpensive and easy to create in mass production.

To form the antenna 10, the stamp 70 is bent by 90 degrees at each of the four bend points 72*a*–*d*. Each of the annular sections 74, 76 of the stamp 70 forms one of the annular conductors 12, 14 of the antenna 10, and the conductive post 78 forms the antenna's shorting post 18. Likewise, the two conductive stems 80, 82 form the conductors 26, 28 of the signal feed element. A non-conductive support (not shown) may be placed between the annular conductors 12, 14 to preserve the shape and dimensions of the antenna 10. Also, a dielectric insulator (not shown here) may be placed within and/or between the annular conductors 12, 14.

Figure 5:
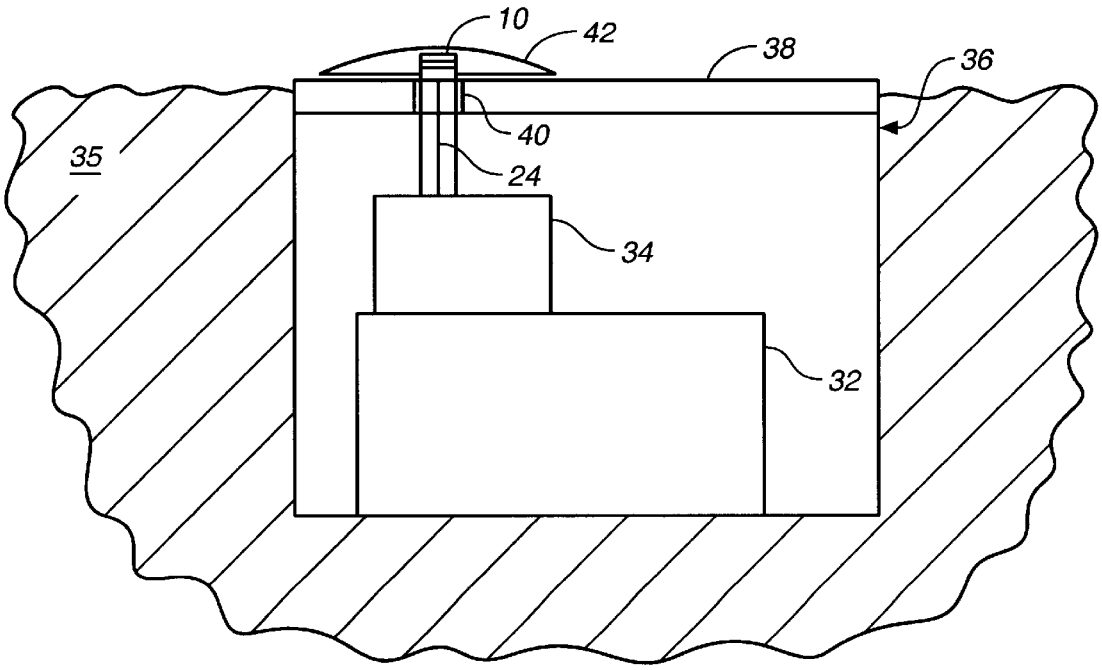
FIG. 5 is a schematic view of a vertically-polarized, omnidirectional antenna connected to a radio transceiver in an underground water meter.

Referring now to FIG. 5, a vertically-polarized, omnidirectional slot antenna 10 is suited for use in remote metering applications in which an underground device, such as a water meter 32, must exchange information over a wireless channel with a control center (not shown). In a typical situation, the water meter 32 and an electronic transceiver 34 are located underground 35 in a housing 36 covered by a lid 38, which typically is made from metal, fiberglass, or some other rigid and durable material. The antenna 10 is positioned either within or just above a standard sized hole 40 (usually less than two inches, and often approximately 1¾", in diameter) formed in the lid 38. A protective housing 42 made, e.g., of durable plastic protects the antenna 10 and secures it to the lid 38.

In operation, the antenna 10 transmits signals provided to it by the transceiver 34 and receives signals transmitted by the control center at an assigned frequency, e.g., a frequency in the "Industrial, Scientific, and Medical" (ISM) band (902 MHZ to 928 MHZ). For a typical antenna operating, e.g., at 920 MHZ ($\lambda_{air}$=12.8") and having an effective dielectric constant of about two, the length of the slot is approximately 4.5", which is approximately ½-wavelength at the effective dielectric constant. The diameter of the antenna is about 1.5", which allows the antenna to fit into a structure passing through the 1¾" hole formed in the housing lid. The height of the antenna 10 in such an application typically is less than 1.0" and often will be 0.5" or less. The height dimension of the lower conductor typically is two to three times greater than the height dimensions of the slot and the upper conductor.

Figure 6:
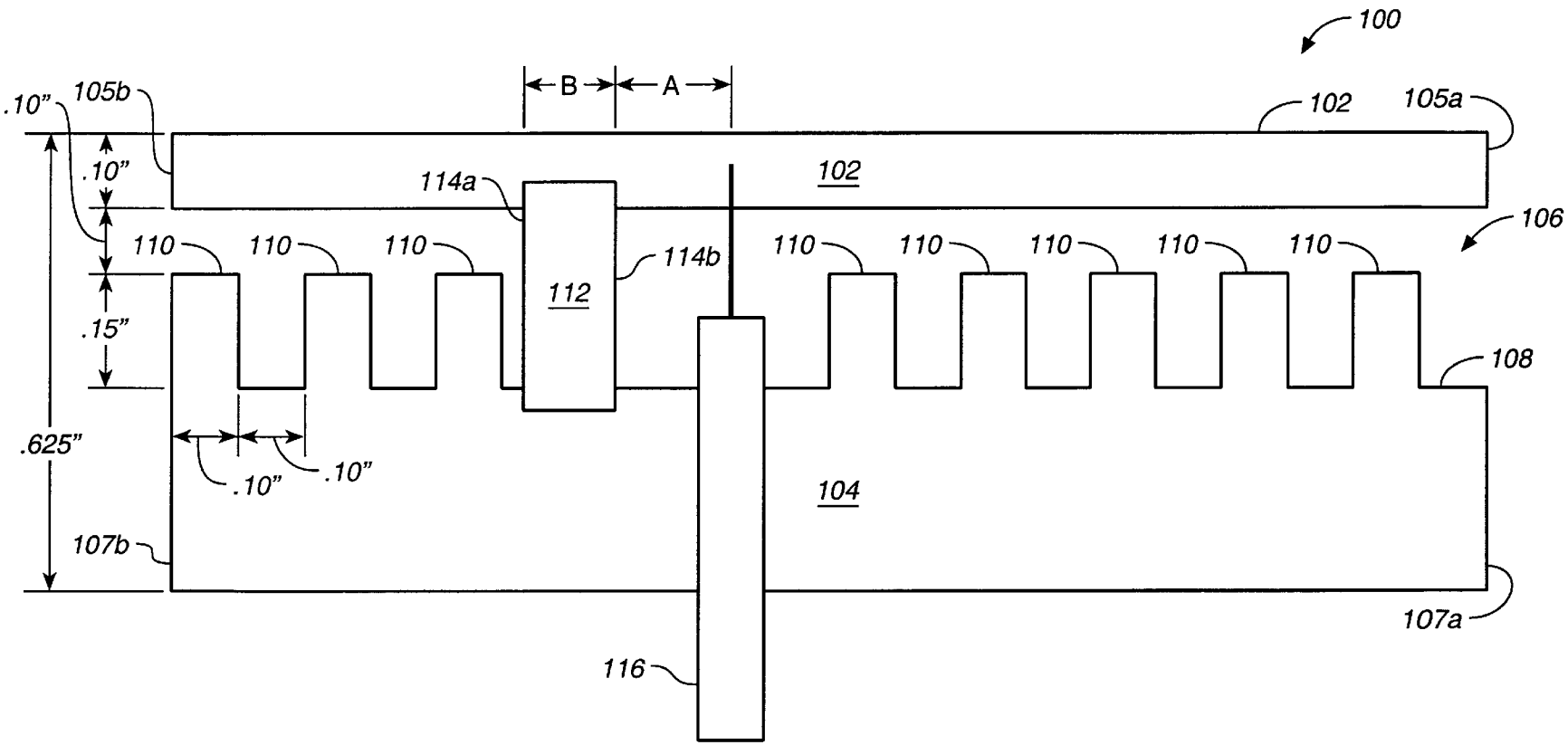
FIGS. 6 and 7 are views of two serrated slot antennas that may be used to form a vertically-polarized, omnidirectional antenna.

Referring now to FIG. 6, a serrated slot antenna 100 may be used instead of the straight slot antenna described above. Like the straight slot antenna, the serrated slot antenna 100 includes two generally parallel conductors 102, 104 separated by a slot 106. One of the conductors 104 has a serrated edge 108, from which serrations 110 protrude into the slot 106. A conductive shorting post 112 connects the conductors 102, 104 to form the ends 114*a–b* of the slot 106. A bipolar signal feed element, such as a coaxial cable 116, connects to each of the conductors 102, 104 to provide signals that drive the antenna.

Each of the conductors 102, 104 may be formed from a strip of conductive material having prescribed dimensions. The serrated conductor 104 may be formed from a single strip that includes the serrations 110, or the serrations 110 may be formed from separate conductive strips that are connected, e.g., soldered, to the conductor 104. Likewise, the conductive shorting post 112 and the coaxial cable 116 may be soldered to the conductors 102. The serrated slot antenna 100 is formed by joining, e.g., soldering, the ends 105*a–b*, 107*a–b* of each conductor 102, 104, respectively.

The serrations 110 typically should be evenly spaced along the edge 108 of the serrated conductor 104 and should be equally proportioned. The width and height of the serrations are determined empirically to provide an effective slot length that is half-wave resonant at the desired frequency for the desired antenna diameter. For an antenna that operates at approximately 920 MHZ with a slot 106 that is approximately 4.5 inches in length, the serrations 110 should be approximately 0.10" wide and should be spaced approximately 0.10" from each other. For a slot 106 having a height of approximately ¼ inch, the serrations 110 should extend approximately 0.15" into the slot. The width (B) of the conductive shorting post 112 is determined by the resonant frequency at which the antenna is to operate. For 920 MHZ operation with a 4.5" slot, the shorting post 112 should be approximately 0.2" to 0.3" wide. The distance (A) between the shorting post 112 and the signal feed position of the coaxial cable 116 is selected to match the input impedance of the antenna to that of the feed element (typically 50+j0 ohms for a fifty ohm coaxial cable).

The serrated slot antenna 100 may not require the use of a dielectric, even when an unserrated slot antenna would, because the serrated slot 106 produces a lower resonant frequency than an unserrated slot produces. As a result, the serrated slot antenna does not suffer from dielectric losses in many applications for which an unserrated slot antenna of the same dimensions would suffer such losses.

Figure 7:
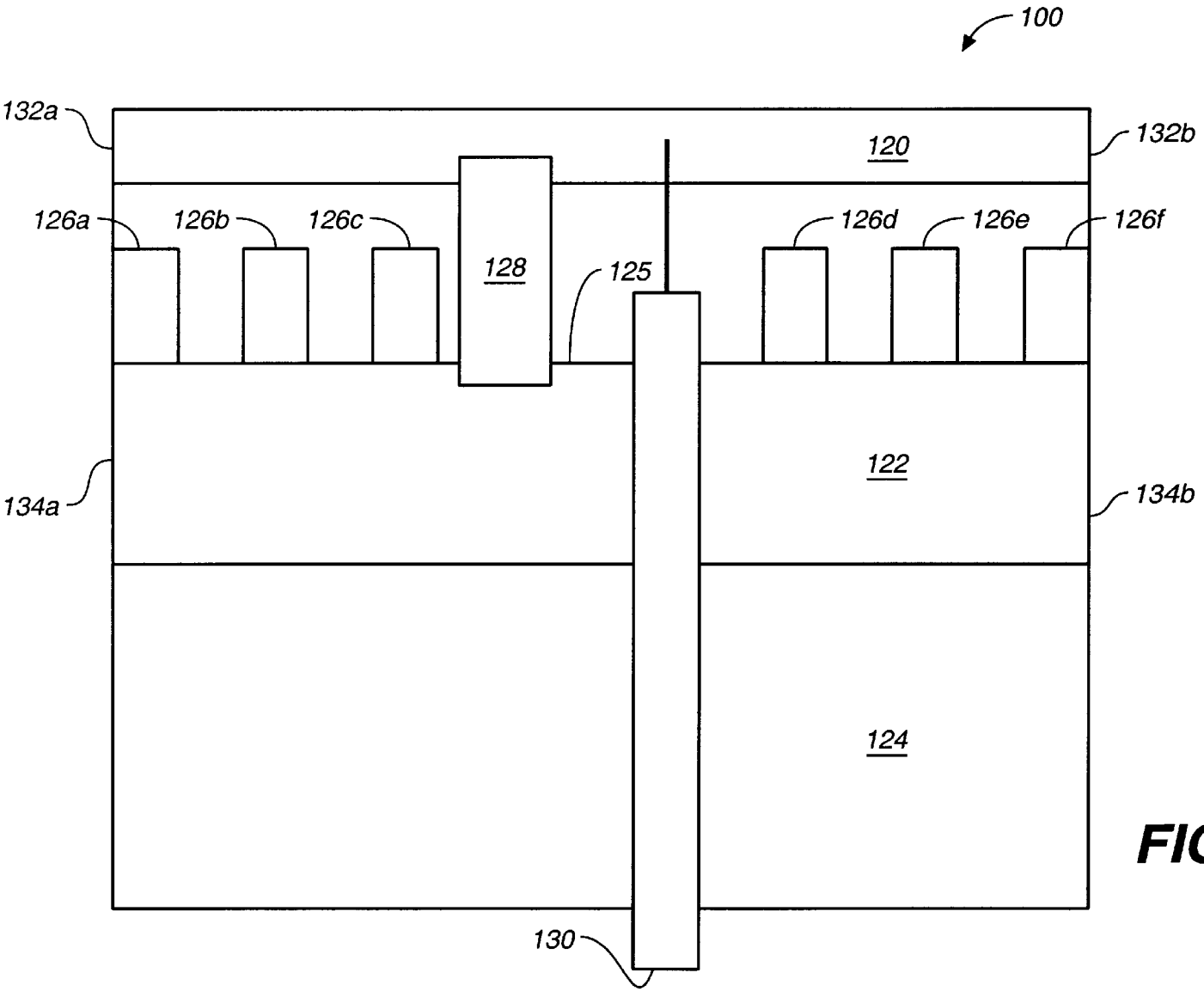

Referring now to FIG. 7, the serrated slot antenna 100 may be formed from two parallel strips 120, 122 of conductive tape affixed to a sheet 124 of flexible substrate material, such as a plastic film. Individual strips of conductive tape also may be used to form serrations 126*a–f* along an edge 125 of one of the conductive strips 122. Each piece of conductive tape forming a serration should be bonded electrically, e.g., soldered, to the conductive strip 122, as should the conductive shorting post 128 and the coaxial cable 130. The ends 132*a–b*, 134*a–b* of the conductive strips 120, 122, respectively, are soldered together to form an annular antenna.

Alternatively, the serrated slot pattern shown in FIG. 6 may be formed on the surface of a flexible substrate, the ends of which may then be joined to form an annular slot antenna. For example, the serrated slot pattern may be photoetched on the surface of a copper-clad flexible substrate, the ends of which may be soldered together to form the annular antenna. In yet another alternative, the serrated slot antenna may be formed from a conductive tubing, such as a copper or brass tubing, by machining the slot, the serrations, and the shorting post into the tubing wall.

Other embodiments of the invention are within the scope of the following claims. For example, the annular conductors may take on any one of numerous shapes, including circular, ovular, hexagonal, etc. Also, the serrations along the edge of the slot may vary from each other in width and height and may be unevenly spaced. The antenna may, in some applications, be mounted within the underground housing, e.g., to the underside of the housing lid. Furthermore, the antenna may be used in a wide variety of applications other than the underground metering application described above.

What is claimed is:

1. An antenna comprising:

two cylindrical conductive elements separated by a slot, one of the cylindrical conductive elements having a serrated edge protruding into the slot; and a third conductive element connecting the cylindrical conductive elements together at some point along the slot.

2. The antenna of claim 1, wherein the serrated edge is formed by serrations protruding from an edge of one of the cylindrical conductive elements toward the other cylindrical conductive element.

3. The antenna of claim 2, wherein each of the serrations comprises a strip of conductive tape.

4. The antenna of claim 3, wherein the conductive tape is affixed to a flexible substrate.

5. The antenna of claim 2, wherein the serrations are evenly spaced.

6. The antenna of claim 4, wherein the serrations each have a width equal to the spacing between the serrations.

7. The antenna of claim 2, wherein the serrations and the conductive element from which they protrude together comprise a single strip of conductive material.

8. The antenna of claim 1, wherein at least one of the cylindrical conductive elements comprises a strip of conductive tape.

9. The antenna of claim 8, wherein the conductive tape is affixed to a flexible substrate.

10. The antenna of claim 1, wherein each of the cylindrical conductive elements comprises a strip of conductive tape.

11. The antenna of claim 10, wherein the conductive tape is affixed to a flexible substrate.

12. The antenna of claim 1, wherein the cylindrical conductive elements each form a cylinder no greater than approximately two inches in diameter.

13. The antenna of claim 1, wherein the cylindrical conductive elements each form a cylinder no greater than approximately 1.5 inches in diameter.

14. The antenna of claim 1, wherein the overall height of the antenna is no greater than approximately 0.625".

15. A method of making an antenna, the method comprising:

providing a generally straight slot antenna having two generally parallel conductive elements, one of the conductive elements having an edge from which serrations protrude toward the other conductive element, the slot having a serrated edge; and securing two ends of the generally straight slot antenna to form a cylindrical serrated-slot structure.

16. A method of making an antenna, the method comprising:

positioning two cylindrical conductive elements to form a slot between them, at least one of the cylindrical conductive elements having an edge from which serrations protrude toward the other cylindrical conductive element; and connecting a third conductive element to each of the cylindrical conductive elements to form at least one end of the slot.

17. A method of making an antenna, the method comprising:

obtaining a flat flexible substrate having a conductive a surface;

forming on the conductive surface a pattern having two conductive elements that run the length of the flexible substrate and that are separated from each other by a non-conductive slot, wherein forming the pattern includes forming on an edge of one of the conductive elements serrations that extend into the slot; and forming on the conductive surface a third conductive element that extends between the other two conductive elements to form at least one end of the slot with a length of the third conductive element being less than that of the slot.

18. The method of claim 17, further comprising joining two ends of the flexible substrate to form a cylindrical antenna.

19. The method of claim 17, wherein forming the pattern includes photoetching the conductive surface.

20. A method of making an cylindrical slot antenna, the method comprising:

obtaining a conductive tubing; and removing material from the tubing to form two conductive rings connected by a shorting element at some point along a perimeter of the tubing;

wherein removing material from the tubing includes forming on an edge of one of the rings serrations that extend toward the other ring.

* * * * *